United States Patent [19]

Ury et al.

[11] Patent Number: 4,485,332

[45] Date of Patent: Nov. 27, 1984

[54] METHOD & APPARATUS FOR COOLING ELECTRODELESS LAMPS

[75] Inventors: Michael G. Ury, Bethesda; Charles H. Wood, Rockville, both of Md.

[73] Assignee: Fusion Systems Corporation, Rockville, Md.

[21] Appl. No.: 381,481

[22] Filed: May 24, 1982

[51] Int. Cl.[3] ..... H01J 7/24

[52] U.S. Cl. ..... 315/112; 315/248

[58] Field of Search ..... 315/112, 117, 118, 248; 313/35, 44, 148, 231; 362/373, 386; 165/80 A, 86

[56] References Cited

U.S. PATENT DOCUMENTS

| | | | |
|---|---|---|---|
| 3,786,308 | 1/1974 | Browner et al. | 315/248 |
| 3,983,436 | 9/1976 | Schafer | 313/35 |
| 3,989,983 | 11/1976 | Uchino et al. | 313/44 |

*Primary Examiner*—David K. Moore

*Attorney, Agent, or Firm*—Pollock, Vande Sande & Priddy

[57] ABSTRACT

A method and apparatus for cooling electrodeless lamps which permits high power density operation, and bright lamp output. The lamp envelope is rotated about an axis passing therethrough while at least a stream of cooling gas is directed at it. A plurality of such streams may be positioned in or near a plane in which envelope hot spots are found to develop. A spherical lamp envelope at the center of a spherical microwave chamber is effectively cooled by this technique.

19 Claims, 3 Drawing Figures

FIG.1
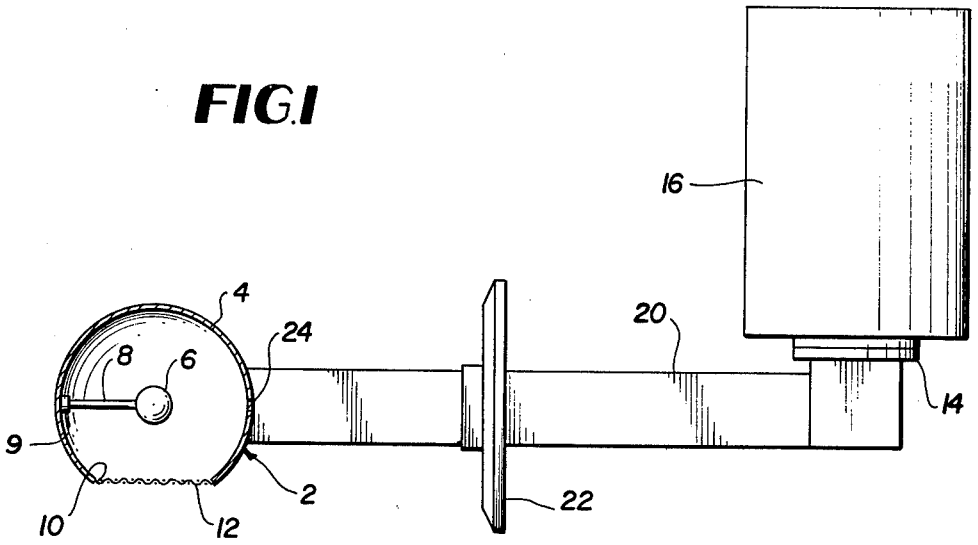
FIG.2
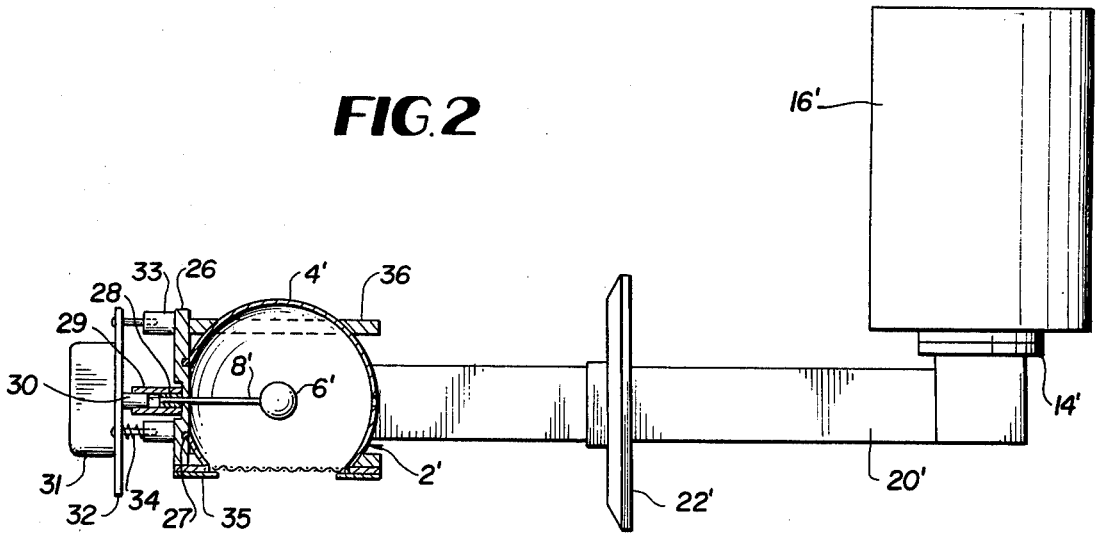
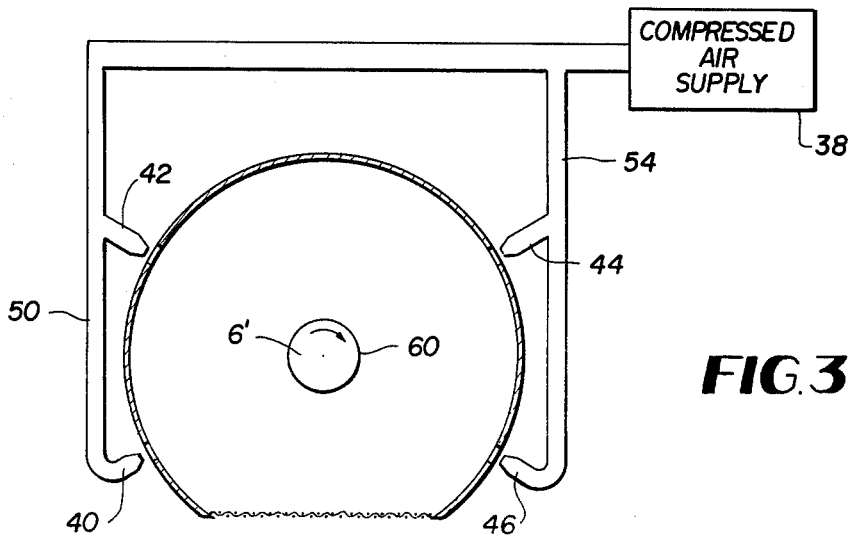
FIG.3

METHOD & APPARATUS FOR COOLING ELECTRODELESS LAMPS

The present invention is directed to a method and apparatus for cooling electrodeless lamps.

The electrodeless lamps with which the present invention is concerned are generally comprised of a lamp envelope containing a plasma forming medium. To operate the lamps, the medium in the envelope is excited, with microwave, R.F., or other electromagnetic energy, thereby generating a plasma, which emits radiation in the ultraviolet, visible or infrared part of the spectrum. Important uses for such electrodeless lamps to date are in the curing of coatings or inks by photopolymerization reaction, and in semiconductor photolithography.

It is known that electrodeless lamps transfer a great deal of heat to the envelopes during operation, and it has been found that the effectiveness with which the lamp envelopes may be cooled is a limiting factor in overall lamp performance. Thus, the brightness with which energy is radiated by the lamp increases with the power density of the microwave or other energy in the lamp envelope, but as the power density increases, so does envelope temperature, with a point being reached where the envelope melts if not adequately cooled. Thus, the brightness which can be obtained from the lamp is ultimately a function of cooling. Also, in the case where a lamp is operating satisfactorily at a given envelope temperature, cooling the envelope further has the effect of substantially increasing bulb lifetime.

The conventional technique for cooling electrodeless lamps is to push or pull air over the stationary lamp envelope. In the conventional positive forced air system, illustrated in U.S. Pat. No. 4,042,850, air from a compressor is pushed into the lamp chamber over the lamp envelope, while in the negative or vacuum type system, air is withdrawn from the chamber over the lamp envelope.

It has been found that the cooling which is afforded by the conventional forced air system is quite limited, which places a limit on the power density at which the lamp can be operated, and therefore also on lamp brightness. The limitations of the conventional cooling system are discussed in Japanese published application No. 55-154097 by Yoshio Yasaki, which states that a power density of 100 watts/cm$^3$ is a limit using forced air, since higher densities cause the lamp envelope to break, and in order to attain a brighter source Yasaki proposes a system wherein the lamp envelope is immersed in water during operation.

It is thus an object of the present invention to provide an improved method and apparatus for cooling electrodeless lamps.

It is a further object of the invention to provide electrodeless lamps which are capable of operating at relatively high power densities.

It is still a further object of the invention to provide electrodeless lamps which are relatively bright.

It is still a further object of the invention to provide electrodeless lamps having a relatively long lifetime.

It is still a further object of the invention to cool an electrodeless lamp without having to immerse the lamp in water.

In accordance with the invention, the above objects are attained by rotating the lamp envelope while directing one or more streams of cooling gas thereat. As the envelope is rotated, adjacent surface portions thereof sequentially appear in the direct path of the stream or streams with the result that the entire surface area is adequately cooled. Using this technique, it has been found that the average surface temperature of a cylindrical envelope was reduced from 850° C. using conventional cooling to approximately 650° C. In an embodiment of the invention using a spherical lamp envelope and a plurality of streams of cooling gas, operation at a power density 500 watts/cm$^3$ has been attained.

The invention will be better appreciated by referring to the accompanying figures in which:

FIG. 1 is a schematic illustration of an electrodeless lamp to be cooled by the method and apparatus of the invention.

FIGS. 2 and 3 are schematic illustrations of an embodiment of the invention.

Referring to FIG. 1, microwave generated electrodeless light source 2 is depicted. The particular source illustrated is a for performing the exposure step in semiconductor photolithography, and is required to produce an extremely bright output.

Light source 2 is comprised of spherical lamp envelope 6 and spherical microwave chamber 4 in which the envelope is disposed. The lamp envelope is typically made of quartz while the chamber is made of a conductive material such as copper or aluminum, and the envelope is held at the center of the chamber by mounting stem 8 which is secured to the chamber wall by flange 9. Chamber 4 has a circular aperture 10 for emitting light which is covered with conductive mesh 12 which is effective to retain microwave energy in the chamber while allowing the ultraviolet light emitted by lamp envelope 6 to escape.

Lamp envelope 6 is filled with a plasma forming medium, for example, mercury in a noble gas. When excited with microwave energy, this medium becomes a hot plasma which emits ultraviolet radiation. The microwave energy is supplied by magnetron 14 which is powered by electrical power supply 16. The microwave energy emitted by the magnetron is coupled to chamber 4 by rectangular waveguide section 20, and coupling is optimized by tuning stub 22. Chamber 4 has a rectangular slot 24 therein for admitting the microwave energy to the chamber and exciting the plasma in envelope 6.

In order for the lamp depicted in FIG. 1 to attain the required brightness, microwave energy at a power density of several hundred watts/cm$^3$ must be coupled to the medium in envelope 6. As mentioned above, this causes the envelope to become extremely hot, and if adequate cooling is not provided, the envelope will melt, and ultimately break. This was precisely the result when the lamp depicted in FIG. 1 was cooled by the conventional forced air system of the prior art.

In accordance with the cooling method and apparatus of the present invention, the lamp envelope is rotated about an axis passing through the envelope while one or more streams of cooling gas are directed at it. As the envelope is rotated, adjacent surface portions of it sequentially appear in the direct path of the stream or stream and thereby experience maximum cooling effect from the streams, with the result that the entire surface area is adequately cooled. A vast improvement results over the prior art system in which a stream of cooling gas is directed at a stationary lamp.

FIGS. 2 and 3 are schematic illustrations of an embodiment of the improved cooling system of the invention, and in FIG. 2 parts identical to these in FIG. 1 are identified with corresponding numerals. Referring to FIG. 2, motor 31 is provided for rotating the stem 8' of the lamp envelope. The motor shaft or an extension thereof extends through an opening in the chamber, which is effectively sealed to the escape of the microwave energy.

Mesh 12 may be attached to the chamber aperture by any mechanical expedient known to those in the art, and in FIG. 2 the mesh is welded to mesh mounting plate 35 which is secured to the chamber.

A variety of mechanical means known to those skilled in the art may be utilized to couple the motor to stem 8. In the embodiment shown in FIG. 2, flange 26 having gasket 27 therein is disposed at the chamber opening, and may for example be supported by being secured to screen mounting plate 35 at one end and to support rod or rods 36 at the other end which are alongside the chamber. Stem 8' has a ferrule 28 at one end thereof which is secured by cementing in cylindrical coupler 29 while the motor shaft 30 is secured, as with a set screw at the other end of the coupler. Thus, the stem 8' is effectively on extension of motor shaft 30. The motor is attached to flange 32, which is secured to flange 26 by mounting posts 33. Spring 34 may be provided, and may be screw-adjusted position envelope 6' at the desired location.

FIG. 3 is a cross-sectional view of FIG. 2 taken through the center of chamber 4' perpendicular to the long direction of stem 8' and illustrates the disposition of the cooling nozzles in the particular embodiment depicted. Thus, nozzles 40, 42, and 44, and 46, which are the terminations of conduits 50, 52,and 54, respectively are disposed behind openings in chamber 4 so as to prevent microwave leakage, and are directed approximately towards the center of the chamber. Compressed air supply 38 is provided, and air under pressure is fed to the conduits and is ejected through the respective nozzles towards rotating envelope 6. While compressed air is depicted for purposes of illustration, other cooling gases such as nitrogen or helium may be used.

As the envelope rotates adjacent surface portions thereto are hit directly with the streams of cooling gas, and the entire surface is adequately cooled. If found to be appropriate, fewer or more than four nozzles may be used. In the embodiment depicted in FIG. 3, using a 0.75" diameter spherical envelope, all of the nozzles are located in a plane passing through the center of the sphere since it was determined that with the configuration shown in FIG. 2 hot spots occur in this plane. However, when a 1.0" spherical envelope was used more cooling was found to be necessary at surface portion 60, and the surface portion diametrically opposed thereto in FIG. 3. Therefore, nozzle 40 was offset slightly to one side of the chamber center plane while nozzle 42 was offset slightly to the other side, and similarly for nozzles 44 and 46.

In the embodiment illustrated, operation at a power density of 500 watts/cm$^3$ is possible because of the great cooling effect provided by the apparatus of the invention. Further, when a cooling system according to the invention was used with a cylindrical envelope, average bulb temperature dropped from approximately 850° C. to 650° C., resulting in substantially longer bulb lifetime.

It should be appreciated that while the invention has been disclosed in connection with a preferred embodiment illustrating a particular electrodeless lamp, it may be used to cool all types of electrodeless lamps including envelopes of cylindrical, toroidal, and other geometry. Additionally, rotating means other than an electrical motor may be used. For example, the streams of cooling gas themselves may rotate the envelope by hitting paddles which are attached to the envelope.

Therefore, it should be understood that many variations which fall within the scope of the invention may occur to those skilled in the art, and the scope of the invention is limited solely by the claims appended hereto, and equivalents.

We claim:

1. A method of cooling an electrodeless lamp having a lamp envelope which gets extremely hot during operation, comprising the steps of, providing at least a stream of cooling gas under pressure, directing said at least a stream of cooling gas at said lamp envelope, and rotating said lamp envelope about an axis passing through said envelope so that surface portions of said envelope about said axis are cooled by said at least a stream of gas.

2. The method of claim 1 wherein said axis passes through the center of said envelope.

3. The method of claim 2 wherein said at least a stream of gas is directed at approximately the center of said envelope.

4. The method of claim 1 wherein said electrodeless lamp comprises a microwave generated plasma lamp.

5. An apparatus for cooling an electrodeless lamp having a lamp envelope which gets extremely hot during operation comprising.

means for providing at least a stream of cooling gas under pressure, means for directing said at least a stream of cooling gas at said envelope, and means for rotating said lamp envelope about an axis passing through said envelope so that surface portions of said envelope about said axis are cooled by said at least a stream of gas.

6. The apparatus of claim 5 wherein said axis passes through the center of said envelope.

7. The apparatus of claim 6 wherein said means for directing at least a stream of cooling gas directs said at least a stream approximately at the center of said envelope.

8. The apparatus of claim 5 wherein said lamp comprises a microwave generated plasma lamp.

9. The apparatus of claim 8 wherein said lamp envelope is disposed in a conductive chamber, and said means for directing said at least a stream of cooling gas comprises at least a nozzle means which is disposed in an opening in said chamber.

10. The apparatus of claim 9 wherein the existence of the plasma in said envelope causes the envelope to develop a hot spot or spots during operation, and wherein said at least one of said nozzle means is disposed so as to be directed at an area at which said hot spot or spots will be during rotation of said envelope.

11. The apparatus of claims 9 or 10 wherein said lamp envelope and said chamber are spherical.

12. The apparatus of claim 11 wherein said spherical chamber includes a slot for coupling microwave energy and wherein said envelope is rotated about an axis passing through said slot, and wherein said at least one of said nozzle means is located in a plane perpendicular to said axis and passing through the center of said envelope.

13. The apparatus of claim 12 wherein said at least a nozzle means comprises four nozzle means disposed in said plane and spaced substantially from each other on said spherical chamber.

14. The apparatus of claim 13 wherein said chamber has an opening for allowing ultraviolet radiation emitted by said envelope to escape, and said plane passes through the center of said opening.

15. The apparatus of claim 8 wherein said means for rotating comprises an electric motor.

16. The apparatus of claim 14 wherein said means for rotating comprises an electric motor having a shaft and a stem connected to the motor shaft at one end and to the lamp envelope at the other end.

17. The apparatus of claim 16 wherein said motor-shaft is disposed directly across said spherical chamber from said coupling slot.

18. The apparatus of claim 5 wherein said lamp envelope is spherical in shape.

19. The apparatus of claim 18 wherein said lamp envelope is disposed in a conductive chamber which is also spherical in shape.

* * * * *